US009067725B1

(12) United States Patent
Sellers et al.

(10) Patent No.: US 9,067,725 B1
(45) Date of Patent: Jun. 30, 2015

(54) COLLAPSIBLE DECORATIVE PLANTER COVER WITH PLANTER SUPPORT BASE

(71) Applicants: Kathleen Sellers, Delray Beach, FL (US); Andres F. Gutierrez, Delray Beach, FL (US)

(72) Inventors: Kathleen Sellers, Delray Beach, FL (US); Andres F. Gutierrez, Delray Beach, FL (US)

( * ) Notice: Subject to any disclaimer, the term of this patent is extended or adjusted under 35 U.S.C. 154(b) by 79 days.

(21) Appl. No.: 13/890,766

(22) Filed: May 9, 2013

(51) Int. Cl.
*A01G 9/02* (2006.01)
*B65D 85/52* (2006.01)

(52) U.S. Cl.
CPC ..... *B65D 85/52* (2013.01)

(58) Field of Classification Search
CPC ..... B65D 85/52; A47G 7/085
USPC ..... 47/72, 41.01; 220/852
See application file for complete search history.

(56) References Cited

U.S. PATENT DOCUMENTS 400,588 A * 4/1889 Meyering et al. ..... 43/56
1,583,083 A * 5/1926 Macaraig ..... 220/9.2
3,014,516 A * 12/1961 Mueller ..... 220/9.2
4,224,754 A * 9/1980 Derryberry ..... 43/1
5,256,461 A 10/1993 Johnson
7,314,553 B1 * 1/2008 Barbe ..... 210/232
7,849,866 B1 * 12/2010 Mangum ..... 135/96
8,201,360 B2 6/2012 Weder et al.
2003/0106895 A1 * 6/2003 Kalal ..... 220/9.2
2005/0034748 A1 * 2/2005 Gadd et al. ..... 135/126
2005/0284866 A1 * 12/2005 Oakner et al. ..... 220/9.2

* cited by examiner

*Primary Examiner* — Tien Dinh
*Assistant Examiner* — Ebony Evans
(74) *Attorney, Agent, or Firm* — Malin Haley DiMaggio & Bowen, P.A.

(57) ABSTRACT

A collapsible planter cover comprising a flexible sleeve and a planter support, the sleeve having an open top, a bottom, and a side wall, the sleeve having a coiled spring disposed around and within the side wall of the sleeve, wherein the coiled spring is configured to allow the sleeve to expand and contract vertically; and wherein the planter support is configured to be disposed within the sleeve at the bottom of the sleeve. A bottom of the support includes one or more feet sized to elevate the cover from a floor surface. In some embodiments, the sleeve and the support are substantially cylindrical in shape and the cover is adapted to receive a potted plant or planter to provide a covering therefore.

4 Claims, 5 Drawing Sheets

COLLAPSIBLE DECORATIVE PLANTER COVER WITH PLANTER SUPPORT BASE

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention generally relates to planter and gardening equipment and more particularly to a collapsible planter cover with a planter support base.

2. Description of Related Art

Pots and planters are common fixtures in home and business settings. Typically a plant or flower will be potted with soil into a pot or planter whereby the planter is a visible item in or around the home or other structure. Aesthetically pleasing planters and pots are typically much more expensive than a basic ceramic or plastic planter, so often times the user has to compromise between price and looks. Further, a planter can become unsightly over time due to corrosion or dirt or the planter simply may not be aesthetically pleasing to begin with. Further still, a traditional planter or pot may be susceptible to leaks, which may cause further damage to the planter, the pot, and its surroundings. Accordingly, there is the need to for a device that improves the aesthetics and functionality of traditional pots and planters by way of a simple, easy-to-use device.

A few attempts have been made at providing devices for use in connection with potted plants and planters. For example, U.S. Pat. No. 5,256,461 to Johnson describes a collapsible flower pot and Christmas tree stand cover comprising a plurality of slats connected to one another by adhesive tape to form a flexible sheet of interconnected slats. The sheet is foldable and is configured to be disposed around a potted plant or a Christmas tree stand. While providing a device to cover a potted plant, Johnson does not provide a way to handle moisture or water or otherwise protect a floor surface from the plant itself. Further, the interconnected slats are not easily transformed into a variety of aesthetic designs and do not completely cover the pot from plain view. U.S. Pat. No. 8,201,360 to Weder et al. describes a method of covering a potted plant or floral grouping with a floral sleeve that comprises a plurality of randomly positioned overlapping folds disposed on side wall of the sleeve. This device, while describing a device for covering a potted plant with an aesthetically pleasing design, does not provide an element to control water and moisture from the plant, nor is the device particularly easy to operate and set up due to its complex overlapping folds. Accordingly, there is a need in the art for a simple, easy-to-use planter or pot cover that is both functional and aesthetically pleasing.

Pots for plants and planters can take up volume for shipping. If a planter cover is rigid, the cover takes up more volume for shopping. It would be desirable to have a planter cover that can be collapsed and stacked for shipping.

It is, therefore, to the effective resolution of the aforementioned problems and shortcomings of the prior art that the present invention is directed. However, in view of the planter and pot equipment and accessories in existence at the time of the present invention, it was not obvious to those persons of ordinary skill in the pertinent art as to how the identified needs could be fulfilled in an advantageous manner.

SUMMARY OF THE INVENTION

A collapsible decorative planter cover and planter support base comprising a cylindrically shaped resilient sleeve and a potter plant support; the sleeve having an open top, a bottom, and a side wall; the sleeve having a coiled spring disposed around and within the side wall of said sleeve; wherein the coiled spring is configured to allow the sleeve to expand and contract vertically; wherein the support is a rigid dish configured to be disposed within the sleeve as a support base platform; and wherein the cover can be mounted around the exterior of a plant pot or planter.

The cover is constructed of a flexible material such as burlap. The cover in some embodiments is cylindrical in shape and includes a closed bottom having apertures that receive the bottom feet from the support positioned in the bottom of the cover.

In some embodiments, the bottom of the support includes one or more feet constructed to elevate the support above a floor surface with reduced pressure on a carpet or floor. The sleeve bottom includes one or more slits sized to receive the one or more feet of the support. The support may be attached to the sleeve by one or more fasteners, such as a clip, clasp or staple. The cover may be configured in a variety of shapes such as a cylinder, box, cone, or the like. The planter support is rigid and water barrier.

Accordingly, it is an object of the present invention to provide a functional collapsible planter or pot cover that provides a collapsible resilient sleeve to cover a planter or pot with a more aesthetically pleasing design while also allowing for the capture of water, moisture, and dirt from the potted plant or flower. In accordance with these and other objects which will become apparent hereinafter, the instant invention will now be described with particular reference to the accompanying drawings.

DETAILED DESCRIPTION

Figure 1:
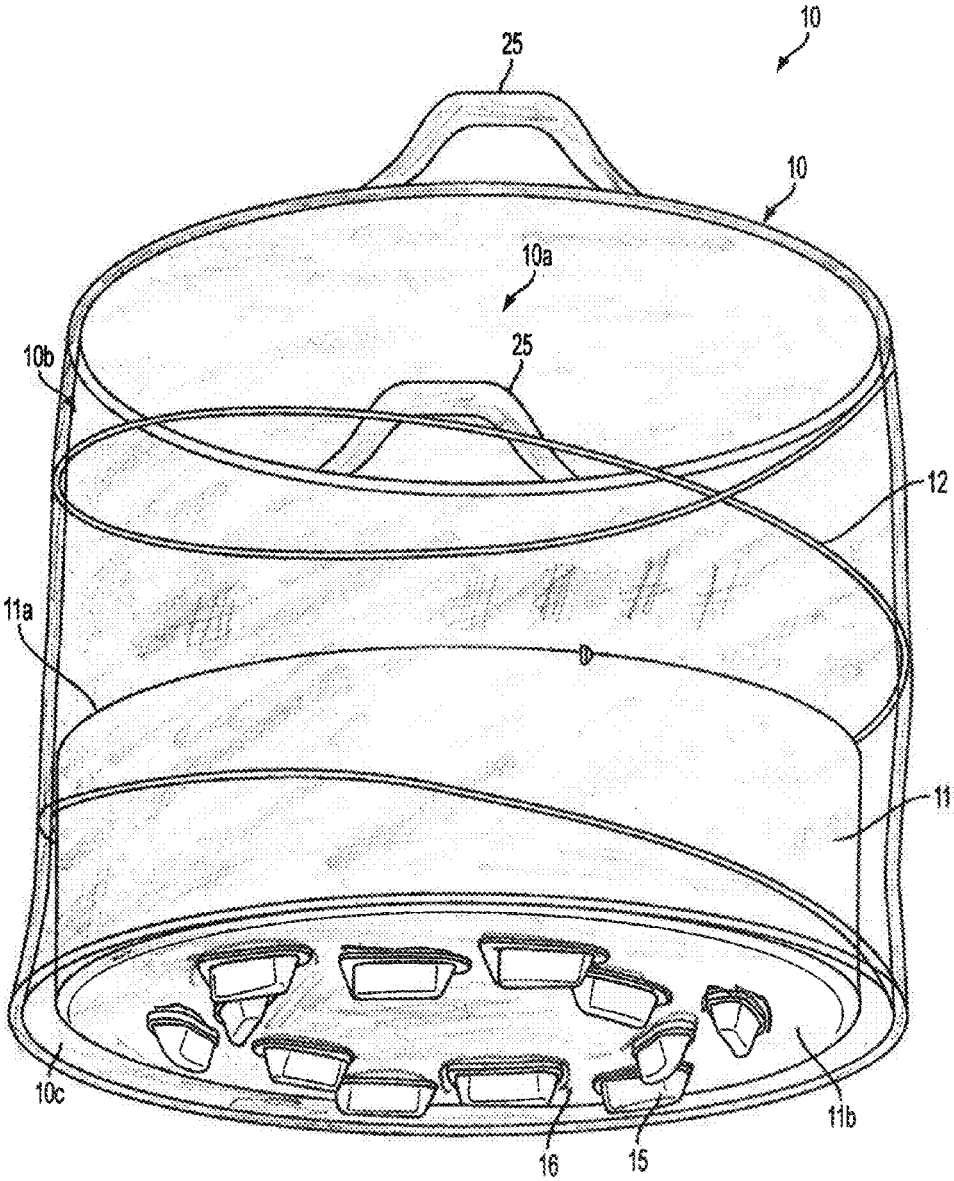
FIG. 1 is a front perspective view of one embodiment of the present invention shown in an assembled state.
Figure 2:
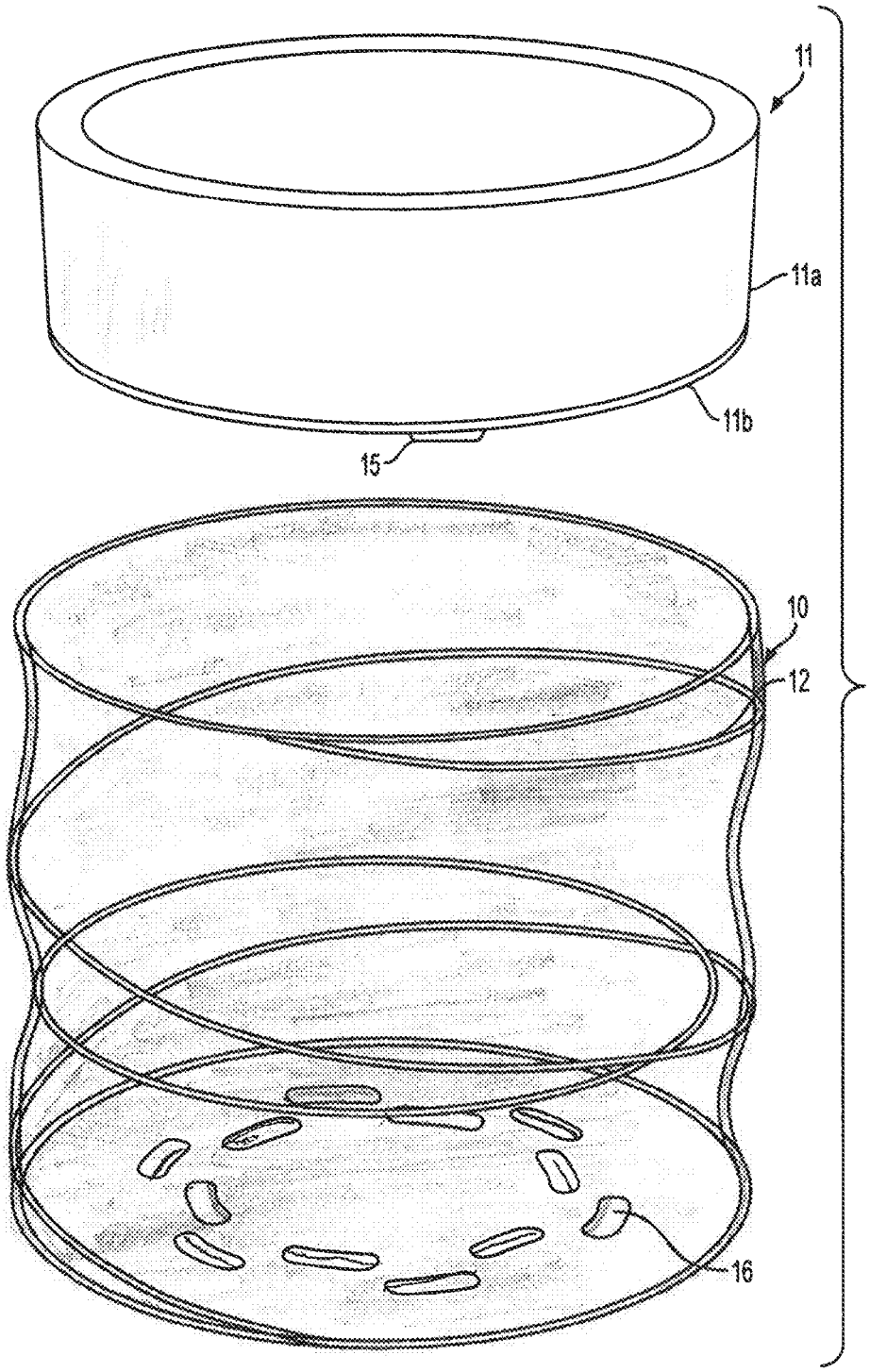
FIG. 2 is an exploded front perspective view of one embodiment of the present invention.

With reference to FIGS. 1 and 2, shown is a collapsible planter cover 10 comprising a resilient fabric mesh sleeve 10 and a planter support sleeve 11. Sleeve 10 includes an open top 10*a*, cylindrical wall 10*b* and at least a partially closed bottom 10*c*. In some embodiments, the sleeve 10 comprises a fabric material such as burlap embedded with a coiled spring 12 to provide for vertical elastic expansion and contracting of the sleeve for shipping. The coiled spring 12 may be wrapped around and within side wall or walls 10*b* of the sleeve 10 or, in the case where sleeve 10 is substantially cylindrical, the coiled spring may be wrapped circumferentially around and within the side wall or walls 10*b* of sleeve 10. In some embodiments, the coiled spring 12 is disposed between two plies of fabric which comprise the sleeve 10. In some embodiments, the coil spring 12 is configured such that the coil spring expands automatically by way of its own coil force vertically when the sleeve itself is not restrained. This allows the sleeve 10 to be deployed or "popped up" automatically when desired. In some embodiments, the sleeve 10 comprises a generally cylindrical shape; however, other shapes and configurations are contemplated herein such as cones, boxes, and the like. The support may be constructed as shown in applicant's U.S. Pat. No. 5,209,013 herein incorporated by reference.

In some embodiments, the support 11 has a vertical cylindrical lip 11*a* within sleeve 10 and may be disposed at the bottom 10*c* of the sleeve 10. The support 11, in some embodiments, has a bottom 11*b* and a circumferential side wall lip 11*a*. Other shapes and configurations, however, are contemplated provided the support 11 serves the functionality described herein. Further, in some embodiments, the outside of the bottom 11*b* of the support 11 includes one or more curved feet 15 which serve to elevate the cover bottom 10*c* from a floor surface as shown and further described herein. To that end, the bottom 10*c* of sleeve 10 may include one or more slits 16 configured to receive the feet 15 of the support 11. These slits 16 allow the sleeve 10 to be disposed closely around the support 11 when in use. A pair of flexible cloth handles 25 can be used to carry the device.

The spring 12 is tensioned and constructed to manually hold the sleeve 10 in an extended vertical position for receiving a potted plant. For shipping the cover with the support base can be manually collapsed vertically and stacked with other planter covers.

Figure 3:
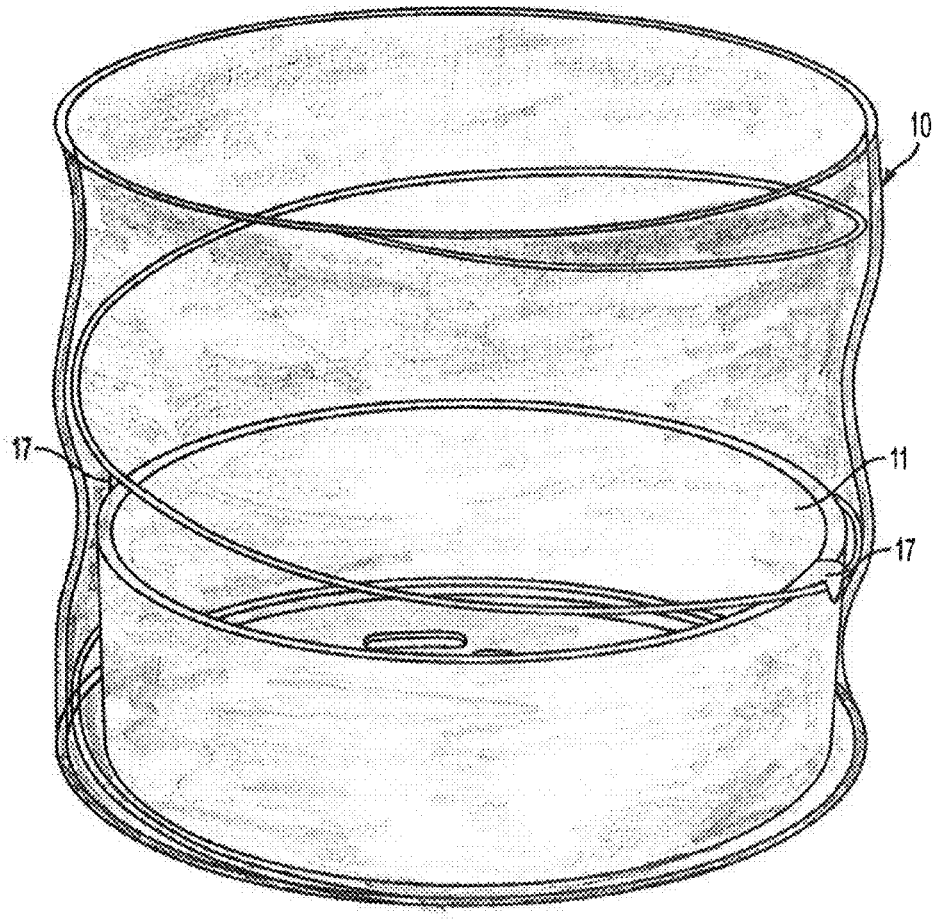
FIG. 3 is a front perspective view of one embodiment of the present invention shown in an assembled state depicting a fastening feature.

As shown in FIG. 3, in some embodiments, for added convenience the support 11 can be attached to the inside of sleeve 10 by one or more fasteners 17. In some embodiments, these fasteners 17 may comprise u-shaped clips that attach the side wall lips 11*a* of the support 11 to a portion of the sleeve 10. In some cases, the fasteners 17 may comprise a variety of fasteners such as clips, clasps, staples, nails, snaps, hook and loop fasteners, and combinations thereof. Other fasteners 17 may be used and would be apparent to those skilled in the art.

Figure 4:
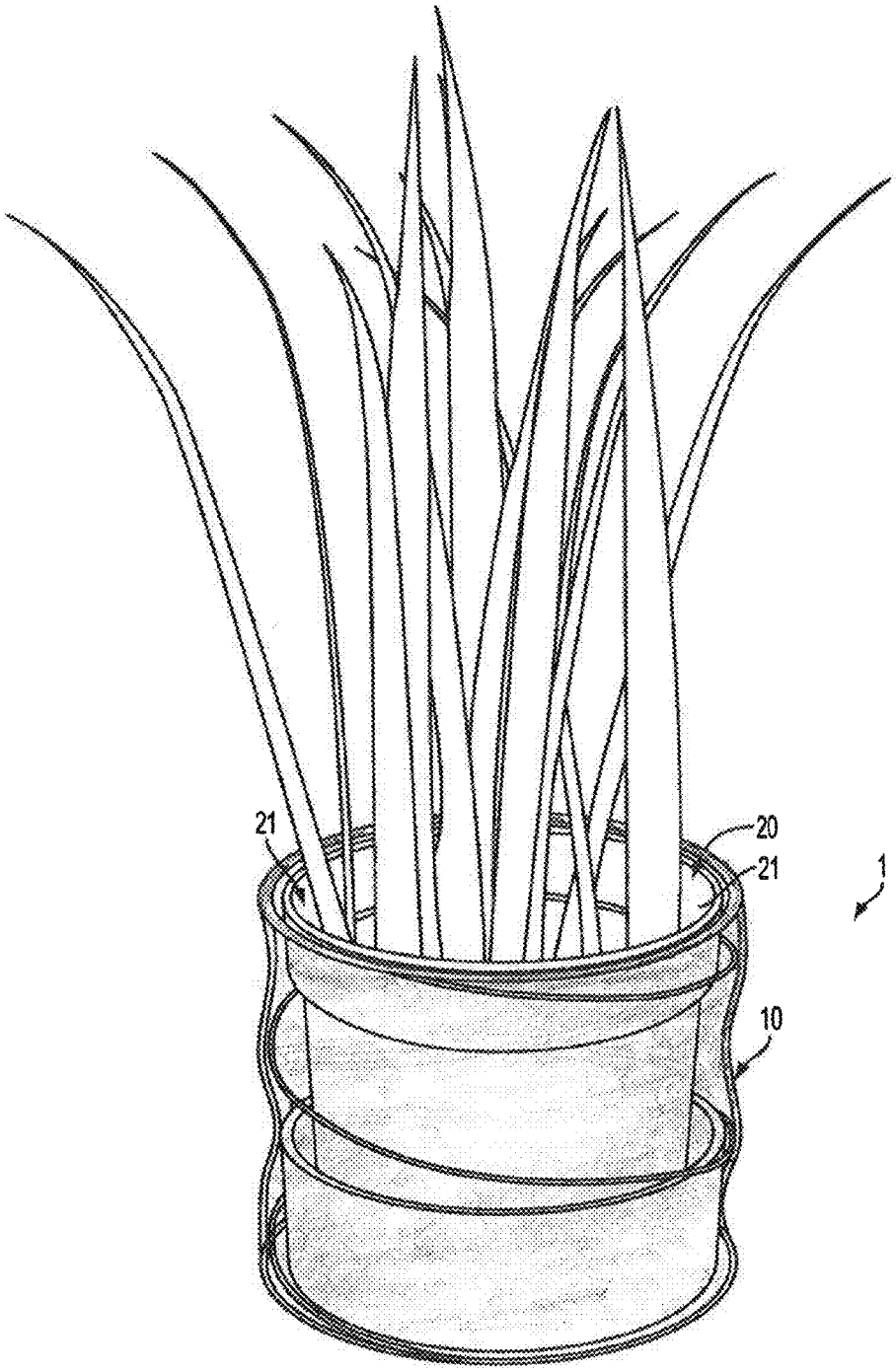
FIG. 4 is a front perspective view of one embodiment of the present invention in use with a potted plant.
Figure 5:
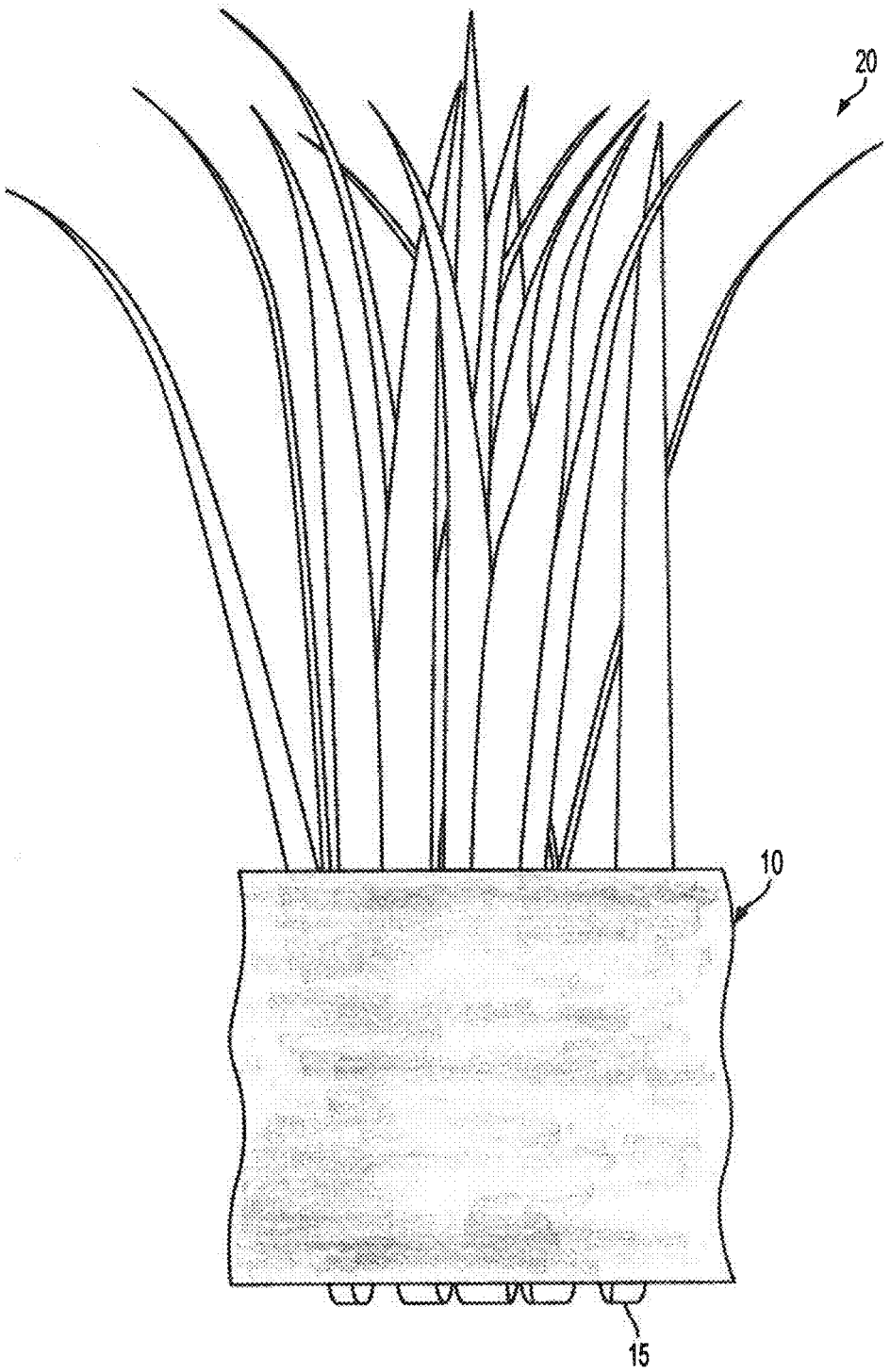
FIG. 5 is a front perspective view of another embodiment of the present invention in use with a potted plant.

Shown in FIG. 4 is the cover 10 of the present invention in use with a potted plant 20. The plant 20 is disposed in a pot or planter 21 which is shown as generally cylindrical or conical in shape. With the present invention in use, pot 21 is disposed within collapsible cover 10 such that the pot 21 rests inside saucer 11. Sleeve 10 is deployed and is therefore disposed around the exterior surface of pot 21, providing an aesthetic cover and support base therefor. In some embodiments, the sleeve 10 comprises a fabric material that includes a variety of colors, designs, indicia, words, and combinations thereof to provide improved aesthetics. In FIG. 4, the sleeve 10 is shown as a translucent mesh in order to better view and understand the present invention, although the mesh could be used in actuality if desired by the user. FIG. 5 depicts the sleeve 15 as being substantially opaque and therefore the sleeve 10 is configured to cover at least a portion of the pot 21 from plain view. As show, the feet 15 of support 11 function to elevate the potted plant and the support 11, and therefore plant 20, from a floor surface. The support feel 15 function as carpet protectors in some embodiments as described in applicant's U.S. Pat. No. 5,209,013 issued May 11, 1993.

It is appreciated that the support 11, with pot 21 disposed therein, provides a rigid barrier to capture water, moisture, and dirt that may be expelled from the pot 21 either over the edges or through the bottom thereof. The support 11 therefore is particularly useful in connection with highly watered plants in that the support provides a barrier to capture water and moisture to prevent water from leaking onto the floor and causing damage.

Although the present invention is depicted in a substantially cylindrical configuration, it is appreciated that other shapes may be equally suitable and fall within the scope of the present invention. For example, the cover 10 could be box-shaped having a box-shaped support 11 and a cubic or box-shaped sleeve 10. Such a configuration would operate substantially as described above and would be useful in accommodating pots of various shapes and configurations. Other shapes and configurations of the cover 21 can be utilized without substantial modification of the present invention.

It is further appreciated that the constituent components of the cover 21 of the present invention may comprise a variety of materials including fabrics, plastics, metals, composites, and combinations thereof. For example, the sleeve 10 may comprise a fabric material and the support 11 may comprise a plastic or resin-like material. Various combinations of materials can be selected as a matter of design choice based on the size, shape, and desired aesthetics of the resultant cover 10.

It is further appreciated that the sleeve of the present invention is configured to expand and contract by way of the coiled spring 12. In some embodiments, the support may be preinstalled within the sleeve such that the saucer remains inside the sleeve even when the sleeve is contracted. This makes for easy storage and set up of the entire device. In other embodiments, the support may be removed when the sleeve is contracted and in some cases the contracted sleeve could be stored within the saucer.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A vertically collapsible planter cover, comprising:

a sleeve and a planter support;

said sleeve having an open top, a bottom, and a side wall;

a coiled spring;

said sleeve having said coiled spring disposed around and within said side wall of said sleeve;

wherein said coiled spring is configured to allow said sleeve to expand and contract vertically;

wherein said planter support is configured to be disposed within said sleeve; and wherein said cover is adapted to receive a cover, a plant pot or planter;

wherein said bottom of said sleeve includes one or more slits adapted to receive said one or more feet of said planter support.

2. The collapsible planter cover of claim 1, wherein a bottom of said support includes one or more feet adapted to elevate said cover from a floor surface.

3. The collapsible planter cover of claim 1, wherein said support is attached to said sleeve by one or more fasteners.

4. The collapsible planter cover of claim 1, wherein said sleeve and said support are substantially cylindrical in shape.

* * * * *